United States Patent [19]

English et al.

[11] 4,352,966

[45] Oct. 5, 1982

[54] SLIDE SWITCH

[75] Inventors: Jack A. English, Elkhart; James E. Greve, South Bend; James N. Hufford, Elkhart, all of Ind.; Durward H. Priebe, Paso Rubles, Calif.

[73] Assignee: CTS Corporation, Elkhart, Ind.

[21] Appl. No.: 125,871

[22] Filed: Feb. 29, 1980

[51] Int. Cl.[3] ..... H01H 15/00

[52] U.S. Cl. ..... 200/16 D

[58] Field of Search ..... 200/291, 303, 16 R, 200/16 C, 16 D

[56] References Cited

U.S. PATENT DOCUMENTS

| | | | |
|---|---|---|---|
| 3,643,046 | 2/1972 | Zdanys, Jr. et al. | 200/16 D X |
| 3,728,499 | 4/1973 | Bang et al. | 200/16 D X |
| 3,729,600 | 4/1973 | Solomon et al. | 200/16 D |
| 4,012,608 | 3/1977 | Lockard | 200/16 D |

FOREIGN PATENT DOCUMENTS

| | | |
|---|---|---|
| 3434 | 8/1979 | European Pat. Off. . |
| 365210 | 1/1932 | United Kingdom . |
| 571898 | 9/1945 | United Kingdom . |
| 1447632 | 8/1976 | United Kingdom . |

*Primary Examiner*—James R. Scott

*Attorney, Agent, or Firm*—John A. Young; Larry J. Palguta

[57] ABSTRACT

A slider consisting of a one or two piece body with resilient contact switch members projecting in opposite directions at spaced intervals along the length of the slider to be in contact with a collector plate on one side and a respective one of spaced contactors at the opposite side. A plurality of ribs or protuberances which are located in the line of movement of the switch members, causes resilient deformation of the switch members to hold the switch in position once it snap fits into one or another of its respective switch positions. The protuberances may be either projections formed integrally in a switch body or on the collector plates.

11 Claims, 8 Drawing Figures

SLIDE SWITCH

BACKGROUND OF THE INVENTION

Miniature slide switches have been provided in the past, typically of a kind illustrated in U.S. Pat No. 3,729,600 issued Apr. 24, 1973, entitled "SLIDE SWITCH ASSEMBLY WITH RESILIENT BRIDGING CONTACT AND TERMINAL STRUCTURE ADAPTABLE TO 8/N POLE CONFIGURATIONS" and British Pat. No. 1,447,632 published Aug. 25, 1976 and entitled "IMPROVEMENTS IN OR RELATING TO ELECTRIC SWITCHES". In prior switches, the switching action does not provide a positive "feel" for switch position so that it is not possible to tell readily whether the switch is in one of its closed positions or between switch closed positions. Because there is an indefinite "feel", the operator cannot readily perceive the closed switch positions. Attempts to correct this have been incorporated into the British and United States patents just referenced. Unfortunately, the switch housing, slide carriage, and associated switch arms suffer from too great a complexity in the number of parts. Also, the switch arms tend to create excessive binding and sticking as the slide is moved from one closed position to the next and thus cause a "smearing" of metal over the opposed rubbing surfaces. When gold is used as one of the conductor materials, there is found to be a definite smearing of gold over the contact surfaces thus preventing a clean on and off switch operation and eventually wearing through contacting surfaces.

SUMMARY OF THE INVENTION

What the present invention proposes is a relatively simple, positive action switch in which there is "feel" so that as the operator moves the switch from one position to the next there is a slight resistance to switch movement which can be readily overcome but which registers with the user as a positive "between switch position" feel followed by a snap-in action at the operative position for the switch. The snap-in action positively locks the switch in its operative location.

It is an object of the present invention to utilize switch arms on the slide as the resilient means opposing movement of the slide from one switch closed position to the next switch closed position.

Another object of the present invention is to provide a resistance to movement of the slider of the switch by means of either cam elements integrally formed with the body of the switch or embossments on the collector plates to resist slider movement and impart "feel" which is so necessary to miniaturized switches when the operator selects one or the other of switch positions.

In the present invention it is intended that the switch have relatively few components which makes it easy to construct and assemble and yet have positive and good "feel" switch operation without skimming the surfaces or causing smearing of the conductor material because of excessive rubbing or resistance to switch movement.

It is an object of the present invention to provide an improved miniaturized switch in which the slide member can be of a one or two piece element and on which the switch arms are positively held in place and do not rock or move in their proper operative position as they are resiliently deformed to develop the desired resilient resistance to switch movement.

An overall object of the present invention is to provide a switch that can be used on PC boards, with terminals on one side of the switch selectively coupled with terminals at the other side of the switch to produce two different circuits depending on slider position and that such switch can be reliably provided with "feel" and a sense of positive feedback to the user who manually operates the switch as desired. A concurrent objective is that the switch have a substantial wear life, be highly producible, and manually operated.

Other objects and features of the present invention will become apparent from a consideration of the following description which proceeds with reference to the accompanying drawings wherein:

DRAWINGS

DETAILED DESCRIPTION OF THE INVENTION

Figure 1:
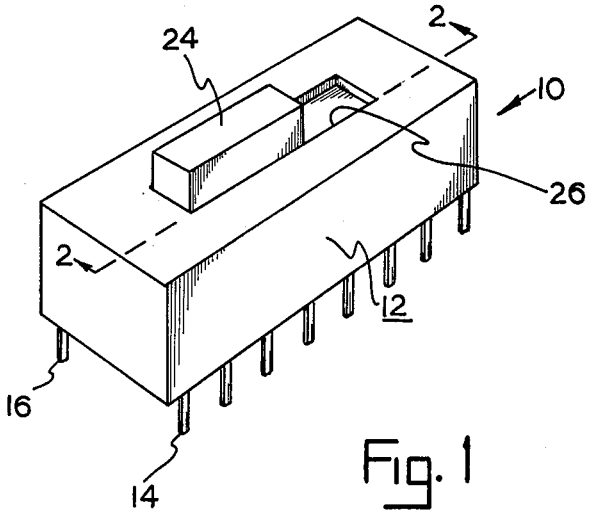
FIG. 1 is an isometric view of a switch in accordance with the present invention.
Figure 2:
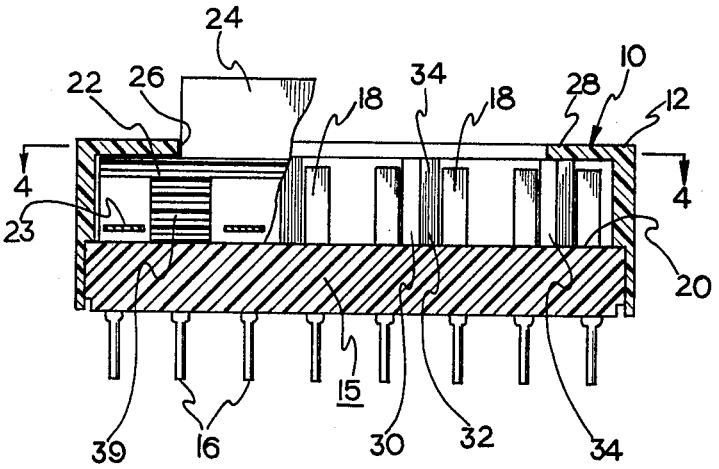
FIG. 2 is a section view taken on line 2—2 of FIG. 1 but with a portion of the slider broken away.

Referring now to the drawings and particularly the embodiment shown in FIGS. 1-4, there is illustrated a switch designated generally be reference numeral 10 and comprising a housing or body 12 with two rows of spaced apart terminals 14 and 16 extending from the switch along two of the longitudinal edges thereof, such terminals being regularly spaced apart in six, seven, eight or nine pairs, etc. depending on the particular design application. Internally of the body 12 is a base 15 wherein the sets of terminals are integrally molded. The base 15 may consist of some electrically inert moldable resin. Each successive pair of adjacent terminals 14 is electrically connected to a respective collector plate 17, there being four such collector plates to accommodate the eight terminals 14. The terminals 16 are each electrically connected with a respective upright contact 18, there being one terminal 16 for each contact 18.

Figure 3:
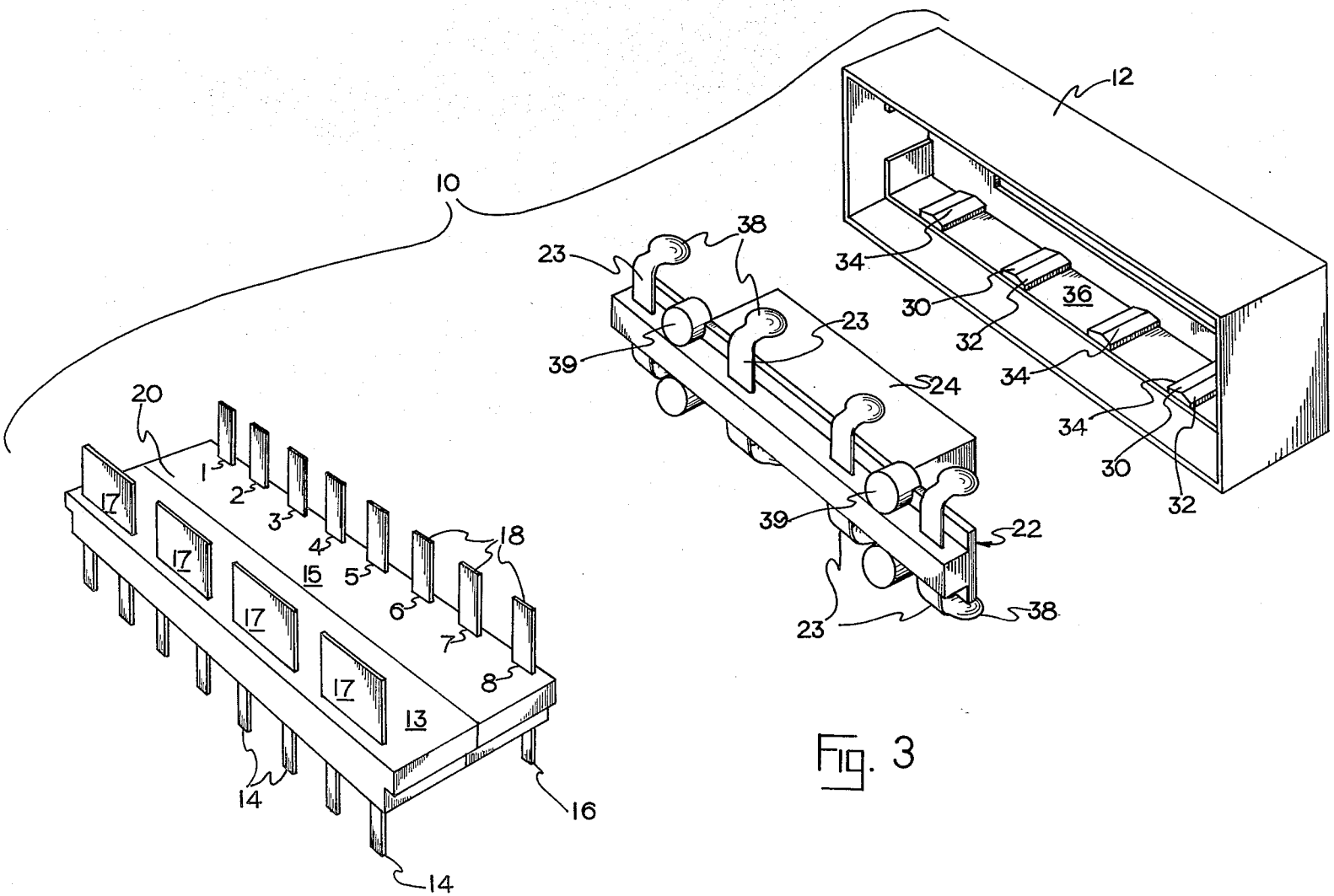
FIG. 3 is an isometric exploded view of the slider and portions of the switch body.
Figure 4:
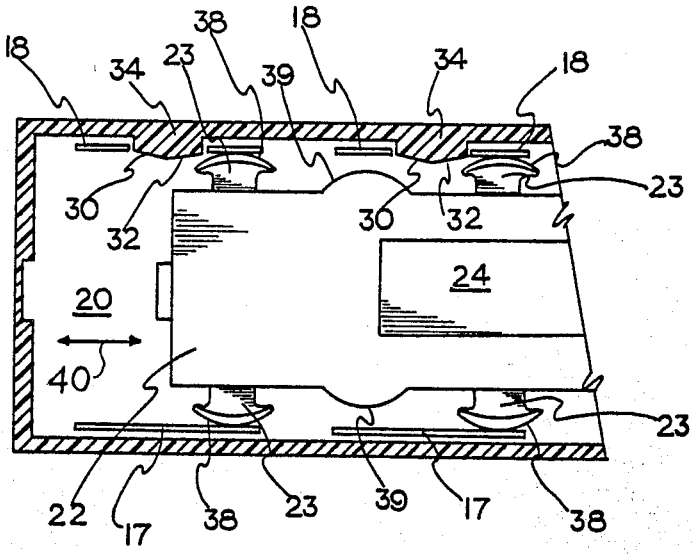
FIG. 4 is a partial section view taken on line 4—4 of FIG. 2.

The upper surface 13 of base 15 provides a bearing surface 20 on which is slidably mounted a slider 22 having a handle or knob 24 extending through a slot 26 in the upper wall 28 of the body or housing 12. Slider 22 is moved back and forth externally of the housing by an operator displacing the handle or knob 24 which is integrally related to the slider 22. Slider 22 has integrally molded therein resilient switch arms 23 which, as shown in FIGS. 3 and 4, extend on opposite sides of the slider 22. Each switch arm 23 is deformably biased, relatively freely, over confronting inclined cam surfaces 30, 32 of projections 34 integrally constructed in the interior wall 36 of the housing 12, such projections separating the terminals 18. Each switch arm 23 is a conductor material such as copper, copper alloy, or the like, and each has a convexly shaped outer end 38 facilitating slidable engagement with the cam surfaces 30, 32 so that each end 38 will slide freely against the surfaces and cause the switch arms to be deformed in an inward direction thereby permitting the slider 22 to move in either of the directions indicated by the double headed line 40 (FIG. 4). The outer ends 38 of the resilient switch arms 23 snap against and make electrical connections with contacts 18. There are half as many switch arm elements 23 as there are contacts 18, so that in one position four switch arms 23 are engaged with contacts 2, 4, 6 and 8 in FIG. 3 and in the next position engage contacts 1, 3, 5 and 7. Thus, there is an electrical circuit from terminals 14 to first and second sets of terminals 16. It is an important feature of the present invention that as the slider 22 is moved in one direction or the other, its movement is positively resisted by the combined resilience of the switch arms 23 as the outer ends 38 thereof deform by engagement with one or the other of the cam surfaces 30, 32 of projections 34. This provides a "feel" when the switch is operated by the handle or knob 24 but once the operative position is achieved for the switch, the switch arm elements 23 snap against the contacts 18 producing an electrical circuit between terminals 14 and one or the other of a set terminals 16.

In assembling the device, the slider 22 is mounted on the bearing surface 20 of base 15 and the base 15 is fitted into body 12 and adhesively joined, if desired, and with handle or knob 24 extending through the slot 26 in body 12. When the two parts are so assembled, the base 15 makes a complete enclosure for the slider 22 within the housing 12. Arcuate bosses 39 integrally formed with the bottom of the slider 22 provide additional bearing surface in contact with surface 20 of base 15 so the slider will not tilt or wobble.

Figure 5:
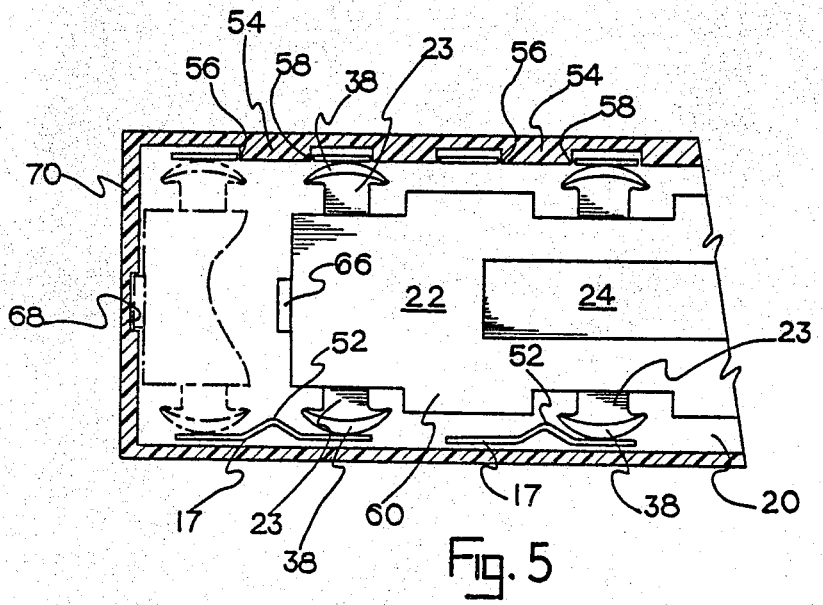
FIG. 5 is a partial section view similar to FIG. 4 but illustrating a different embodiment for resiliently deforming the switch arms on the slide.

Referring next to the embodiment shown in FIG. 5, as an additional method of imparting "feel" or resistance to movement of the slider 22, each collector plate 17 may include a ribbing or embossment 52 so that as the ends 38 of the switch arms 23 bear thereagainst, the arms 23 are caused to resiliently deform and thus oppose movement of the slider 22. As shown in FIG. 4, when the collector plate is relatively flat there is no such resistance but in the embodiment shown in FIG. 5 the collector plate is embossed as described to develop resistance to such slidable movement. In lieu of the projections 34 (FIG. 4) having inclined cam surfaces 30, 32, there is a boss 54 (FIG. 5) having corner edges 56 and 58 which are intially engaged by the ends 38 of the switch arms 23 causing the arms to become slightly resiliently deformed and thereby opposing movement of the slider 22. Consequently resistance to movement of the slider is developed by each of the switch arms 23 in each direction of attempted movement of the slider. Because there is resistance at both sides of the slider, and not at just one side, there tends to be a more balanced feel preventing binding of the slider since each of the lateral sides of the slide is impeded rather than just one side. The slider 22 is drawn so that the full-line position (FIG. 5) illustrates a first switch position and the dotted line position illustrates a second switch position. Each switch arm 23 is separated from the next adjacent switch arm by an enlarged cross-section portion 60 of the slider 22 in order to reinforce the slider. At the opposite ends of the slider is an abutment 66 which at one remote switch position fits into socket 68 of an end wall 70 providing a positive stop against further movement in one direction and a companion abutment and socket is provided at the opposite end wall (not shown) to limit movement in the other direction.

Figure 6:
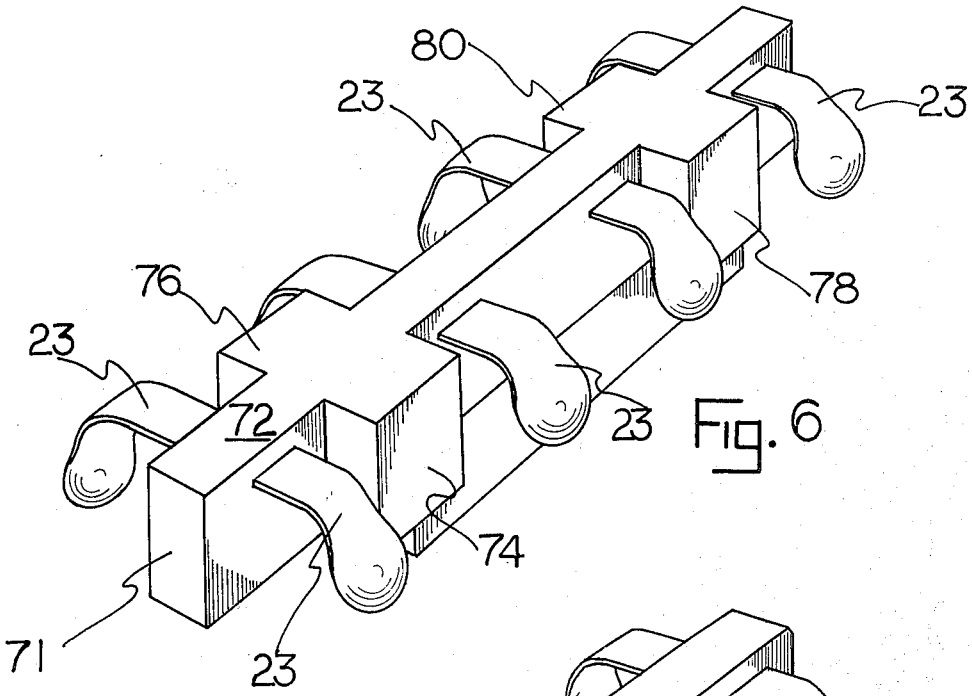
FIG. 6 is an isometric view illstrating a still further embodiment of a one piece slide.
Figure 7:
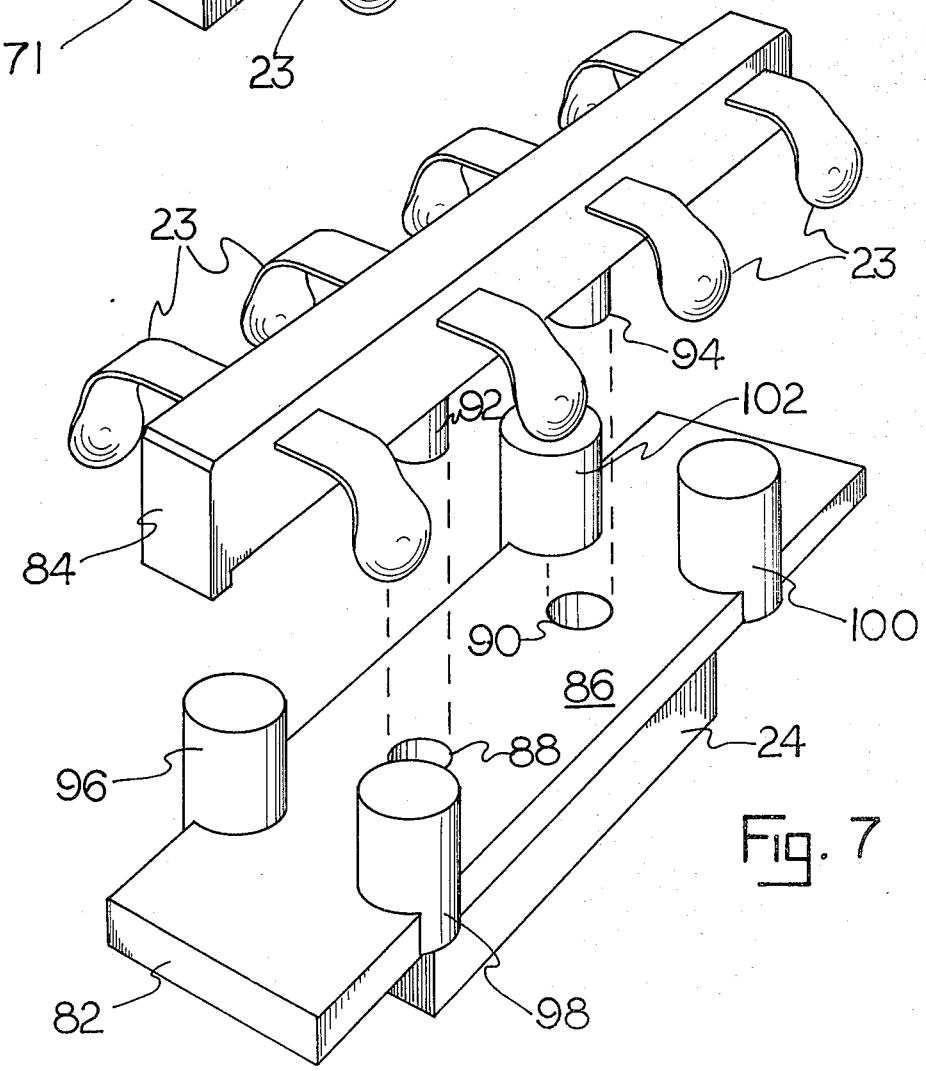
FIG. 7 is an isometric exploded view of a two piece slide.
Figure 8:
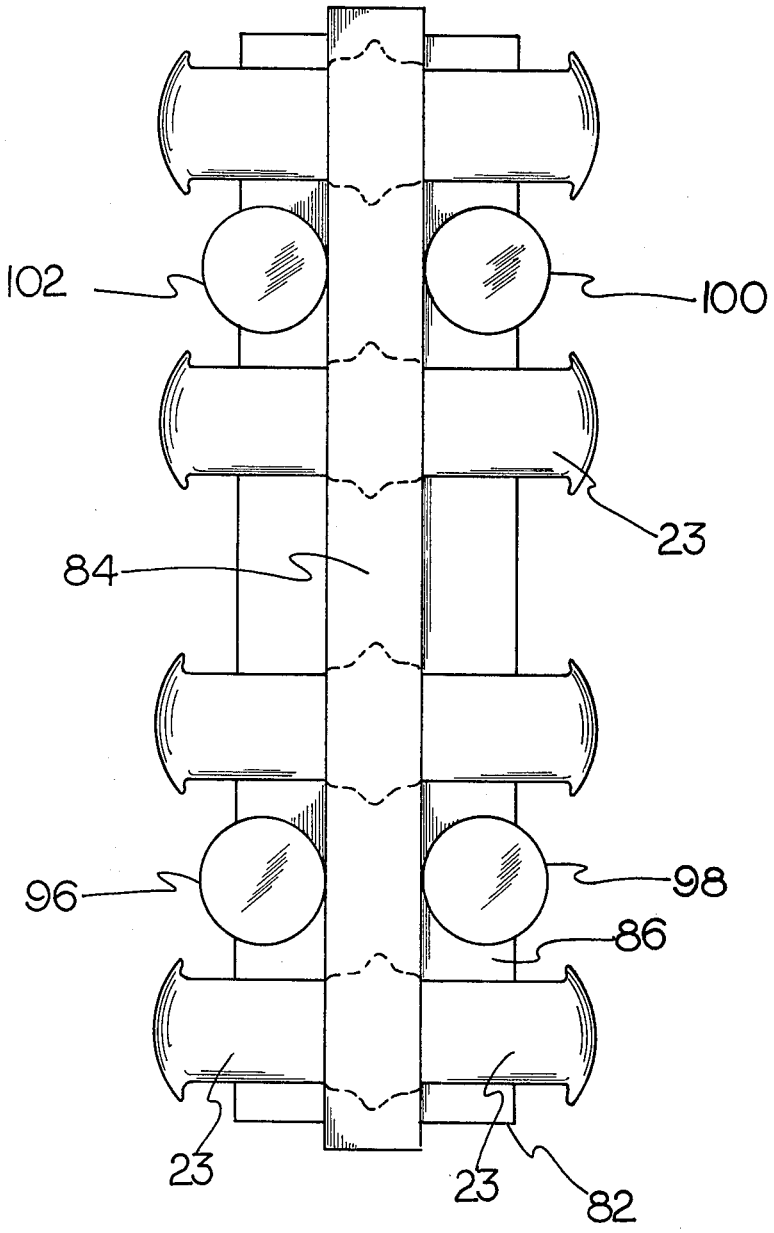
FIG. 8 is a bottom view of an assembled two piece slide shown in FIG. 7.

Referring next to the embodiments shown in FIGS. 6–8, and more particularly FIG. 6, there is illustrated a slide 71 having a relatively narrow central portion 72 and spaced rectangular enlargements 74, 76, 78 and 80, the prupose of which is to enlarge the bearing surface in contact with bearing surface 20 of base 15 and preventing tilting or tipping of the slider as it moves back and forth. It is essential that the movement of the slider be limited to rectilinear movement and that it have at all times a positive "non-rocking" engagement relative to the base 15 which supports the slider in its rectilinear movement. Likewise, it is essential that the switch arms 23 be resiliently moveable as they pass over the opposing cam surfaces and create the "feel" as before described, and not move or rock in any other direction. To insure against any movement, the switch arms are molded integrally into the portion 72 at the time of forming the slider 71 from a heat hardenable resin. In this way there is a reliable snap-action contact once the slider reaches its operative first or second position, and there is no impositive switch arm movement.

Referring to the embodiment illustrated in FIGS. 7 and 8, the slider 82 is constructed in pieces as shown in FIG. 7, the first slider section designated by reference numeral 84 being of relatively narrow cross section and receiving the resilient switch arms 23 and the second slider section 86 having socket openings 88 and 90 which receive posts 92 and 94 to lock the two pieces together. Cylindrical bosses 96, 98, 100 and 102 are engageable with the bearing surface 20 of base 15 so that the two assembled slider sections are caused to slide together in non-rocking relation. The second slider section 86 includes knob 24 extending through slot 26 in the manner previously described.

OPERATION

In operation, a miniaturized switch 10 is mounted on a PC board with the terminals 14, 16 electrically connected to terminations on the board. The knob 24 is then moved in one direction or the other, to produce a circuit from terminal set 14 to terminal set 16 electrically connected in a preferred manner. As the knob 24 displaces the slider 22 in one direction or the other, there is a positive "feel" enabling the operator to know whether he is intermediate a switch position or at a given switch position. Once the switch is in one or the other of its designated positions, after having passed through the resiliently opposed "transitional" phase, the switch positively locks in its operative position and opposes accidental dislodgment except by effort of an operator again displacing the slider.

Internally of the switch, resilient opposition to switch movement is effected as shown in FIG. 4 either by the switch arms 23 engaging inclined cam surfaces 30, 32 on projections 34 from the interior wall 36 or by opposition on both sides developed by engagement of switch arms 23 with bosses 54 and ribbing or embossments 52 of collector plates 17 (FIG. 5). The operation of the slider 71 shown in FIG. 6 is the same as previously described for the operation of the slider 22 in FIGS. 1–5.

In a switch having a slider as shown in FIGS. 7 and 8, the slider 82 is final assembled by inserting posts 92, 94 within openings 88, 90 (FIG. 7) and the two assembled sections 84, 86 are then mounted upon the base 15 of the switch with the cylindrical bosses 96, 98, 100 and 102 providing bearing engagement with the bearing surface 20 of base 15. The switch 10 is then assembled as a whole and the switch arms 23 will resiliently engage bosses 54 and embossments 52 (FIG. 5) to develop the yieldable resistance to actuation of the slider to respective switch positions. The purpose is to connect selective terminals 14 to selective terminals 16 by appropriate placement of the slider relative to the collector plate 17 and contacts 18.

The base 15 can be heat deformed, adhesively joined, or snap-fitted by interference fit to the body 12, whichever is desired. The composition or the resin which makes up base 15 and body 12 may be varied, typical compositions being a phenolic resin. But this is only one of a number of different compositions readily available and useful for the present invention, it being understood that the composition of such is not part of the present invention.

CONCLUSION

The present invention constitutes an inexpensive reduced number of components in a miniaturized switch which is moveable between two positions and intermediate the two positions is a resilient opposition creating a "feel" by which the operator knows that he is either at a switch position or at an intermediate position. Once in a switch position, the slider is resiliently locked in place.

The method of construction, taking into account the few number of components, and assembly are simple and produce a highly reliable switch which obviates the previous smearing or contacts, and further obviates the indefinite positioning of the switch characterized by many of the prior art switches which do not attempt to secure "feel".

While the present invention has been illustrated and described in connection with these few selected example embodiments it will be understood that these are illustrative of the invention and not restrictive thereof. It is reasonably to be expected that those skilled in the art can make numerous revisions and adaptations of the invention and it is intended that such revisions and adaptations will be included within the scope of the following claims as equivalents of the invention.

What is claimed as new and desired to be secured by Letters Patent of the United States is:

1. A slide switch comprising a housing having oppositely disposed walls including a base wall, first and second laterally spaced apart rows of terminals projecting from one side of the base wall, a plurality of collector plates projecting from an opposite side of the base wall and each collector plate electrically connected to a pair of terminals from the first row of terminals, a plurality of upwardly projecting contacts disposed opposite the collector plates and each contact electrically connected to a respective terminal of the second row of said terminals, a slider in slideable bearing relation with the opposite side of said base wall and selectively moveable in relation to said collector plates and contacts, resilient contact switch members molded integrally with said slider to effect a distortion-free, positive and slip-free connection therebetween, with said resilient contact switch members projecting in diverging directions from opposite sides of said slider, each of said switch members being wipably engageable with a collector plate and contact respectively, means secured to said slider and projecting from said housing for manually displacing the slider to switch positions wherein the switch members are disposed in corresponding selected circuit positions, and biasing means slideably engageable by selected ones of said switch members and separating the corresponding circuit positions to yieldably oppose the manual displacement of said slider and respective switch members which are yieldably deformed as they pass over said biasing means and thereafter positively hold said slider at a switch position.

2. The slide switch in accordance with claim 1 wherein the biasing means comprises spaced projections formed integrally with a wall of the housing and which separate successive contacts.

3. The slide switch in accordance with claim 1 wherein the resilient contact switch members at one side of said slider are wipably engageable with a respective smooth collector plate surface.

4. The slide switch in accordance with claim 1 wherein each of the switch members is curved on the surface thereof confronting the complementary contacts and collector plate to facilitate sliding and wiping engagement with the respective contacts and collector plates.

5. The slide switch in accordance with claim 1 wherein a top cover wall is disposed opposite the base wall and has a slot therein, said manual displacement means projecting through the slot in said top cover wall with the top cover wall sealing the interior of the housing and thereby confining the slider for slideable movement therein.

6. The slide switch in accordance with claim 1 wherein said housing consists of an electrically inert resin composition.

7. The slide switch in accordance with claim 1 wherein the biasing means comprises a rib separating portion of each collector plate contacted by a respective switch member at selected circuit positions and wall projections formed between successive contacts, said ribs and projections yieldably deforming respective resilient contact switch members as the members move from one selected circuit position to a next selected circuit position, the ribs and projections thereby providing yieldable resistance to movement of the slider and thereafter holding the slider in each switch position.

8. The slide switch in accordance with claim 7 wherein said ribs and projections provide a positive detent when the slider is moved from one switch position to the next.

9. The slide switch in accordance with claim 1 wherein the resilient contact switch members have a yieldable, resilient, relatively thin cross section and wipably engageable ends curved to reduce frictional resistance from engagement with respective collector plates and contacts.

10. The slide switch in accordance with claim 1 wherein the slider and manual displacement means comprise two separable elements, the one element comprising an elongated rectangular member having the resilient contact switch members spaced longitudinally and fixedly mounted therein and including locating pins, the other element comprising a slider section having complementary openings for receiving said locating pins and spaced apart bearing surfaces provided by bosses on said section to provide stabilizing surfaces which locate the two elements in relation to the housing.

11. The slide switch in accordance with claim 1 wherein the slider and manual displacement means comprises a single slider element having enlarged bearing portions to provide substantial bearing surfaces that locate the element within said slider switch.

* * * * *